US005181726A

United States Patent [19]

Piaget

[11] Patent Number: 5,181,726

[45] Date of Patent: Jan. 26, 1993

[54] APPARATUS AND METHODS EMPLOYING ELASTIC CORDS WITH HAND BALLS

[76] Inventor: Gary D. Piaget, 1435 W. Silver Meadows Dr., Park City, Utah 84060

[21] Appl. No.: 773,451

[22] Filed: Oct. 9, 1991

[51] Int. Cl.[5] ..... A63B 67/10

[52] U.S. Cl. ..... 273/414; 273/58 C; 273/58 E; 273/58 G; 273/330

[58] Field of Search ..... 273/412, 413, 414, 415, 273/319, 329, 330, 58 C, 58 E, 58 G

[56] References Cited

U.S. PATENT DOCUMENTS

| | | | |
|---|---|---|---|
| 439,396 | 10/1890 | French | 273/58 C |
| 667,563 | 2/1901 | Oakley | 273/58 C |
| 672,099 | 4/1901 | Jackson | 273/58 C |
| 729,473 | 5/1903 | Wilson | 273/58 C |
| 1,632,825 | 6/1927 | Diebold | 273/58 C |
| 3,480,280 | 11/1969 | Gamertsfelder | 273/415 |
| 3,843,126 | 10/1974 | Bandy | 273/414 |
| 3,940,133 | 2/1976 | Civita | 273/58 C |
| 4,127,268 | 11/1978 | Lindgren | 273/58 C |
| 4,240,629 | 12/1980 | Song et al. | 273/58 C |
| 4,836,555 | 6/1989 | Wexler | 273/414 X |
| 4,867,451 | 9/1989 | Mitchell | 273/58 C |

*Primary Examiner*—William H. Grieb

*Attorney, Agent, or Firm*—Salter, Michaelson & Benson

[57] ABSTRACT

A ball and elastic cord is affixed to a finger band so that the ball may be thrown, retrieved and paddled by a user's hand. A finger band comprising a strip wrapped about and secured to a finger by locking means such as frictional fabric pads hold the cord snugly about a finger. The cord is firmly secured while permitting adjustment of cord length by threading through apertures in stiffened plates on opposite sides of the strip. The ball in one embodiment has a fabric cover internally filled like a bean bag with plastic pellets and contains a semi-spherical internal cup anchor for securing the cord to the ball. An electronic circuit with a spring biased switch responds to a predetermined force threshold on the cord for signalling by audio or visual means identifying different balls to be used in various games. One or more photo-diode lamps thus can identify one of several balls or players directly or by means of shaped decals, etc. A translucent ball cover may respond by fluorescence to light to store the signal after a momentary switch contact. The ball is manipulated in game steps to actuate the signal by the magnitude of force on the ball at the end of a throw or in response to external forces by contact with another player's ball or cord.

14 Claims, 1 Drawing Sheet

APPARATUS AND METHODS EMPLOYING ELASTIC CORDS WITH HAND BALLS

TECHNICAL FIELD

This invention relates to games and toys, and more particularly it relates to hand manipulated balls with elastic ball return cords.

BACKGROUND ART

There are various prior art ball like toys, similar in some respects to yo-yos and paddle balls attached to a paddle, having cords attached to the ball so that they may be thrown and retrieved, as set forth in U.S. Pat. No. 439,396 to W. French, Oct. 28, 1890; U.S. Pat. No. 667,563 to F. Oakley, Feb. 5, 1901; U.S. Pat. No. 672,099 to W. Jackson, Apr. 16, 1901; U.S. Pat. No. 729,473 to D. Wilson, May 26, 1902; U.S. Pat. No. 1,632,825 to C. Diebold, Jun. 21, 1927; U.S. Pat. No. 3,940,133 to B. Cirita, Feb. 24, 1976; U.S. Pat. No. 4,127,268 to T. Lindgren, Nov. 28, 1978 and U.S. Pat. No. 4,867,451 to T. Mitchell, Sep. 19, 1989.

However, the prior art has not taken into account some critical factors related to the dynamic performance of retrievable balls attached to cords. For example, when balls are thrown out and reach the end of the cord, the dynamic impact force tends to rip the cord from the ball, thus making the cord-to-ball joint critical. Further, the manner in which the cord is held by the hand is critical to avoid discomfort, to permit ball control, adjustment of cord length, and to withstand the dynamic impact imposed by the ball. Another factor that is critical to the use of the ball and the way it performs when thrown and caught is the nature of the ball itself and the interaction with the accompanying cord. Particular care must be taken with elastic cords to avoid catastrophic failure and to provide a desired dynamic action in use of the ball. The prior art has not produced a ball satisfactory in these respects. It is therefore an object of this invention to provide improved structure to overcome the foregoing deficiencies.

While, various auxiliary functions aiding and abetting the enjoyment of the ball in use are known as represented by whistles, and return mechanisms within the balls in some of the above cited patents, this invention has the further objective of providing improved functional performance of the ball by means of accompanying novel controls initiated by circumstances encountered in use by the dynamic action of the ball, together with accompanying methods of use of the improved ball structure.

Other objects, features and advantages of the invention will be found throughout the following description.

DISCLOSURE OF THE INVENTION

The invention generally relates to a finger held ball-cord device with elasticity that returns the ball after being thrown when the cord length is spent to catch or "paddle" with the palm of the hand in connection with developing ball handling skills and playing various games.

A snug, comfortable finger grip is essential for ball control, to prevent slack and to avoid finger damage from repeated impact at the end of the ball travel. Furthermore, the finger grip requires a cord-to-finger-grip coupling that will withstand the repeated dynamic impacts and remain comfortable. Preferably the cord coupling permits adjustment of the cord length to fit various games, desired dynamic performance, or for use by child and adult alike.

Also, the nature of the ball and its coupling to the cord, along with the cord characteristics, are critical in terms of life, dynamic performance, functioning of the ball, comfort and skills. Thus, in accordance with a preferred embodiment, the ball has a soft, pliable outer cover fabric and is filled with plastic pellets to give the appropriate shape, weight and feel. The cord is attached inside the cover to a coupler member, for example an inverted semi-spherical cup that distributes the dynamic force over a larger surface area, provides the ability to withstand the impact when the ball reaches the end of the cord.

For particular use in games, at night, for identification or just for visual enjoyment, an electrically actuated system inside the ball can be actuated by manipulating the cord. For example, one or more identification lamps may be lit when a spring biased switch is actuated by impact when the ball reaches the end of the cord or the cord is otherwise manipulated in a manner that actuates a switch.

The novel ball construction features lead to novel games and methods of manipulating the ball in accordance with this invention. Exemplary is the multi-person game in which the participants throw the ball towards a common focal position about which the participants are ringed, with the intent to avoid being entangled with the cords of other balls. Entanglement can be immediately signalled by a sound or light emitted by the closed switch occurring when a participant tries to retrieve the ball and it is held by interference with the cord of another ball. The last remaining participant that either avoids a signal by manipulating a cord to prevent either entanglement or the emission of the signal then wins.

Alternately a night-vision war game might be played to win over a participant by flashing a lighted ID in the close vicinity of a hiding combatant.

Accordingly it is evident that this invention provides a novel and improved ball device and methods of use, which is described in more detail in the following description with reference to the accompanying drawings.

BRIEF DESCRIPTION OF THE DRAWINGS

As may be seen in the accompanying drawings, wherein like reference characters are used in the several views to indicate similar features.

THE PREFERRED EMBODIMENTS

Figure 1:
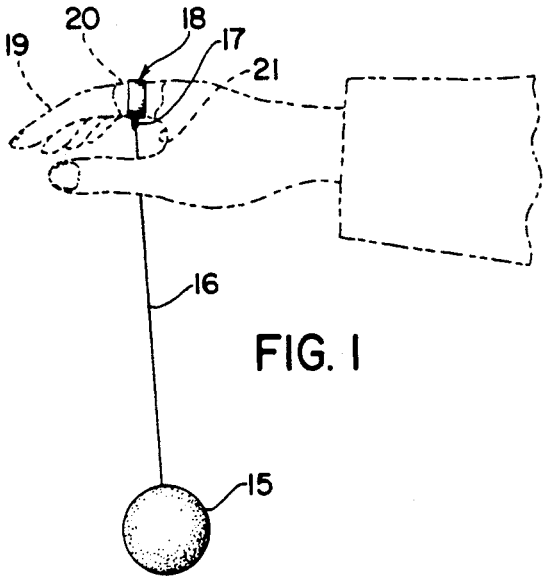
FIG. 1 is a side view sketch, partly broken away, showing that the ball device of this invention is worn on the middle finger so that the palm of the hand can be used to paddle the ball.

In FIG. 1, the ball 15 is affixed to the lower end of the elastic cord 16, which in turn is coupled at joint 17 to a finger band 18 worn on the middle finger 20 behind forefinger 19. This permits the palm of the hand 21 to either catch or paddle back the ball 15 when it is thrown and returned by the elastic cord during manipulation on the cord 16 at the will of the user.

Figure 2:
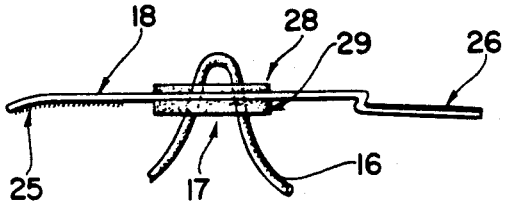
FIGS. 2 and 3 respectively show side and perspective views of a finger attachment member which is adjustably coupled to the ball retrieving cord.
Figure 3:
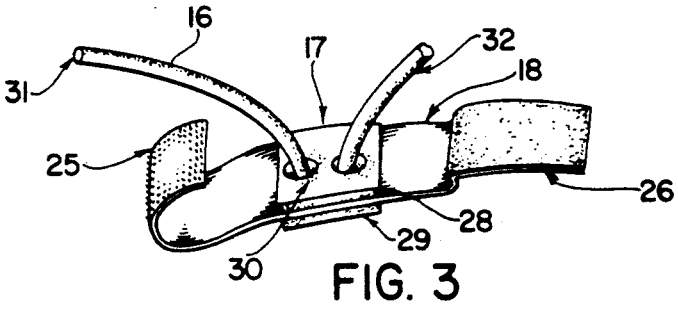

As seen in enlarged detail views of FIGS. 2 and 3, the construction of the unfolded finger band 18 and the cord 16 to band coupler 17 is shown. The finger band 18 is a firm plastic or fabric band with cooperative securing means 25, 26 on opposite ends of the band to constitute means for holding the band firmly in place about fingers of various size without slack. The width of the band is sufficient to support the securing means over a relatively large surface area of the resident finger. The constituency of the fabric or plastic band is such that it will at least in part distribute any impact forces affecting the resident finger over a wide enough surface area to prevent discomfort and irritation. Typically the securing means can be attached patches of adhering fabric members generally known by the trademark VELCRO. This, increases ball control and in part solves the problem of discomfort, abrasion or damage to the finger during manipulation of the ball 15 caused by any loose fitting, snapping, or limited surface finger conforming attachment to the cord.

The attachment of the cord to the finger band is critical, especially if provision is made for replacement or change of length of the cord 16 to conform with different games or user physiques. Thus, the two plastic or metal plates 28, 29 located on opposite sides of the finger band 18 fabric are supplied with mating apertures for threading the cord 16 through the shown assembly. It is thus evident that the length of the cord 16 may be changed or that a new cord may be coupled to the finger band 18 securely in a manner that will withstand the impact of the ball-cord in use and further contribute to ball control and the comfort and health of the user. Note the tear-drop shape 30 of the apertures which bites into and locks the cord 16 more firmly in place. Any loose end of the cord 31, when the ball is attached to the portion 32, may be wrapped about the fingers or arm so that it does not interfere with the use of the device. It is easily recognized that the physics in distributing the impact from the action of the ball 15 at the end of the stroke, so that the life of the band is disproportionally increased and the likelihood of ball control and comfort is increased. Also the functional feature of accommodating a variable length cord is pertinent to the extended utility of the device for use in different modes or games and by children and adults alike.

Figure 4:
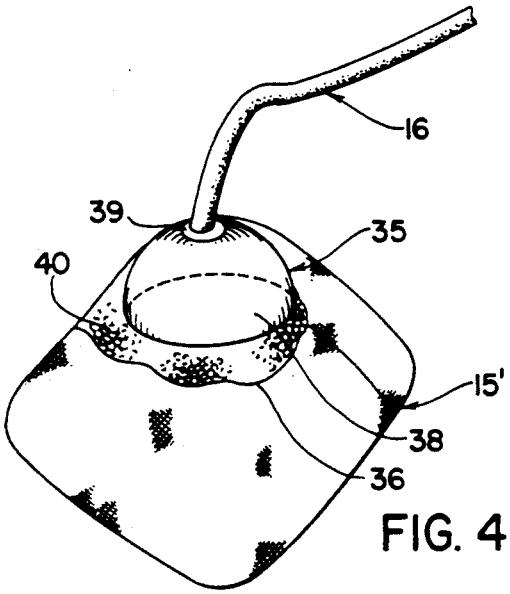
FIG. 4 is a perspective sketch, partly broken away, showing the nature of the ball as afforded by this invention and the cord-to-ball coupling.

The modified ball embodiment 15' of FIG. 4 provides various functional advantages. For example, the manner of attachment of cord 16 to the ball withstands the shock and impact encountered during use without damage to the cord 16, the cord to ball connector 35, or the pliable fabric hide 36 preferably employed with the ball 15' and assures long life under various conditions of use. In this embodiment, the cord to ball connector comprises the semi-spherical cup 38, preferably of a plastic, with a grommet-like aperture 39 for receiving the cord 16, which may be knotted or otherwise secured inside the cup 38.

As shown, the ball 15' need not be spherical in shape, particularly for playing some games. In this embodiment the ball 15' has a bean-bag like configuration, being filled with small plastic pellets 40 to give it appropriate body and weight. The pellets 40 are placed in the ball with the cord 16 pulling the cup 38 to the surface fabric, which is apertured to register with the cup aperture 39, and thus is held in place by the pellet packing inside the ball.

The operation of the ball is critically dependent upon its weight to elasticity of the cord ratio. This controls the travel distance and speed of the return with a given amount of force. In operation a lighter ball or a greater elastic return force will produce a faster return stroke. Thus, the balls may be custom designed for different age groups, games or skill levels by choices of cord length, ball weight and configuration and the elasticity of the cord.

Figure 5:
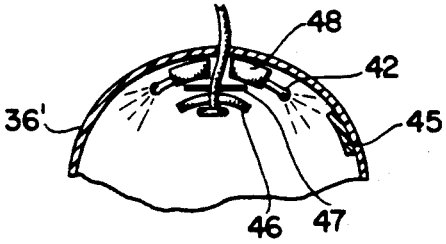
FIG. 5 is a side view sketch with a portion of the ball in section, showing an internally mounted cord actuated electronic system for signalling in response to manipulation of the cord.

As seen in FIG. 5, a transparent or translucent ball cover 36' is provided for making visible by conveying or distributing light from the internally disposed lamp 42 or lamps so that it is externally visible. The cover 36' may for example be of a fluorescent plastic that will respond to ultra-violet rays from the lamp 42 and store the light for a predetermined time period after a flash. The electronic circuit could provide a delay effect which keeps lamp lite for a predetermined time after the switch opens. In another embodiment, the cover 36' or the lamps 42 may be patterned for identification of a player in a game, such as by flashing one or two lamps for visual identification, or by putting a shaped decal of flurescent material on the inside of the cover at 45.

The lamps 42, or an alternative tone identification beep, are initiated when a force on the cord 16 is exerted great enough to pull closer disc 46 against spring biased switch arm 47 to close an electric circuit. The electronic circuit 48 can carry a small battery for example and light photo emitting diodes as lamps 42, which under intermittent operation only when switch arm 47 is closed, will produce little battery drain. Other audio or visible identification means may be used. This device makes an ideal night use toy where for example it winks like a fire-fly at the end of the outward stroke. The spring bias may be such that it does not normally let the switch 47 be closed without an additional manual force co-inciding with the end of the stroke, thus taking some skill or dexterity to light. Such is ideal for playing a war game at night for example, when an "enemy" can be "shot" when discovered by throwing the ball and "pulling the trigger" at the end of the stroke.

Another multi-person game in which the fluorescent memory of the flashing light may be used is "tag" or "elimination" played similar to musical chairs so that the survivor wins. Thus, the players are circled about an "encounter zone" which each player can reach with the ball. Thus, each player throws at the encounter zone trying to get the other players to snarl cords or otherwise get eliminated when their lights flash, or their cords tangle.

It is therefore seen that this invention has advanced the state of the art by providing improved elastic hand ball equipment and methods of use. Thus, those features of novelty setting forth the spirit and nature of the invention are set forth with particularity in the following claims.

I claim:

1. A ball system for use in a play activity that requires manipulation by a hand of a user, comprising a ball, an elastic cord, one end of which is interconnected to said ball, and a single loop finger band interconnected to the other end of said elastic cord and being mountable on a single finger of said user, wherein the palm of the hand of the user faces in the direction of the ball as interconnected to said cord, said single loop finger band having a width that extends over a relatively large surface area of said single finger, wherein impact forces affecting the single finger in the play activity of the ball system are distributed over a relatively large surface area of said single finger for preventing discomfort and irritation to said single finger, said elastic cord providing for return of said ball toward the palm of the user's hand after the ball is thrown by the user during the play activity thereof.

2. The ball system of claim 1 further comprising, means for adjustably securing the cord at variable positions along its length to the finger band.

3. The ball system of claim 1 said band comprising a strip of predetermined length having locking members located near the ends thereof for overlapping and locking in place on the back of the users finger.

4. The ball system of claim 3 wherein said locking members further comprise frictionally engaging fabric members.

5. The ball system of claim 1 wherein said ball comprises a fabric cover filled with plastic pellets.

6. The ball system of claim 5 wherein said ball further comprises an internal apertured plastic member for receiving and securing said cord to said ball.

7. The ball system of claim 1 further comprising signalling means inside the ball for producing a signal in response to a force of predetermined magnitude on said cord.

8. The ball system of claim 7 wherein the signalling means comprises an audio device.

9. A ball system for use in a play activity that requires manipulation by a hand of a user, comprising a ball, an elastic cord, one end of which is interconnected to said ball, and a finger band interconnected to the other end of said elastic cord and being mountable on a finger of said user, said finger band having a width that extends over a relatively larger surface area of said finger, wherein impact forces affecting the finger in the play activity of the ball system are distributed over a relatively large surface area of said finger for preventing discomfort and irritation to said finger, said elastic cord providing for return of said ball toward the hand of the user after the ball is thrown by the user during the play activity thereof, means for adjustably securing the cord at variable positions along its length to the finger band, and a pair of stiffened plates located on opposite sides of the finger band with two apertures in each and in the finger band in registration in a position for threading the cord through the apertures to secure the cord to the finger band.

10. The ball system of claim 9 further comprising substantially tear shaped apertures oriented towards each other in said plates for frictionally engaging the cord in a locking position when threaded through the apertures.

11. A ball system for use in a play activity that requires manipulation by a hand of a user, comprising a ball, an elastic cord, one end of which is interconnected to said ball, and a finger band interconnected to the other end of said elastic cord and being mountable on a finger of said user, said finger band having a width that extends over a relatively large surface area of said finger, wherein impact forces affecting the finger in the play activity of the ball system are distributed over a relatively large surface area of said finger for preventing discomfort and irritation to said finger, said elastic cord providing for return of said ball toward the hand of the user after the ball is thrown by the user during the play activity thereof, signalling means inside the ball for producing a signal in response to a force of predetermined magnitude on said cord, and said signalling means comprising an electrically switched lamp.

12. The ball system of claim 11 wherein the signalling means further comprises identification means to distinguish a particular ball.

13. The ball system of claim 11 wherein the signalling means further comprises means responsive to a momentary switch for lighting the lamp during a switching period that the momentary switch is actuated, and delay means for extending the lighting period beyond the momentary switching period.

14. A ball system as claimed in claim 1, said ball including a flexible cover having an opening formed therein, a semi-spherical member enclosed within said ball cover and having an opening formed therein that communicates with the opening in said ball cover, said cord extending through the openings in said ball cover and semi-spherical member and being locked within said semi-spherical member, said semi-spherical member distributing the forces on the underside of said ball cover that result when the ball is located in a fully extended position of said cord to prevent the cord from dislodging from said ball cover.

* * * * *